US005873530A

United States Patent [19]

Chizinsky

[11] Patent Number: 5,873,530

[45] Date of Patent: Feb. 23, 1999

[54] LIQUID ATOMIZING SPRAY GUN

[76] Inventor: George Chizinsky, 143 W. Street, Beverly Farms, Mass. 01915

[21] Appl. No.: 938,159

[22] Filed: Sep. 26, 1997

[51] Int. Cl.[6] ..... B05B 7/30

[52] U.S. Cl. ..... 239/318; 239/346; 239/349; 239/369; 239/375

[58] Field of Search ..... 239/310, 314, 239/318, 337, 340, 344, 346, 348, 349, 354, 369, 370, 375; 222/3, 631, 340, 388

[56] References Cited

U.S. PATENT DOCUMENTS

| | | | |
|---|---|---|---|
| 1,822,553 | 9/1931 | Uphoff et al. . | |
| 2,057,434 | 10/1936 | Jaden et al. | 239/318 X |
| 2,127,189 | 8/1938 | Scullari et al. | 299/88 |
| 2,264,312 | 12/1941 | Hothersall | 299/89 |
| 2,435,647 | 2/1948 | Engseth | 222/340 X |
| 2,635,921 | 4/1953 | Deutsch | 299/86 |
| 2,876,041 | 3/1959 | Farmer | 239/318 |
| 3,782,598 | 1/1974 | Basa | 222/340 X |
| 4,477,023 | 10/1984 | Gates | 239/340 |

*Primary Examiner*—Andres Kashnikow
*Assistant Examiner*—Robin O. Evans
*Attorney, Agent, or Firm*—Louis J. Franco

[57] ABSTRACT

There is provided a liquid atomizing spray gun of the general type that produce single, finite bursts of gas/liquid mixture which overcomes disadvantages of prior designs in that it does not depend for pressurizing and propelling gas on the squeezing of a trigger while aiming the device throughout the spraying stroke and in which a gas compressing piston is not driven by or otherwise directly mechanically linked to a trigger. These and other objectives are achieved in part by providing a spray gun with a chamber containing a gas tight piston that is reciprocable within the chamber, but wherein the piston is not reciprocated by the trigger. Instead, the piston is independently drawn to a rearward position for drawing gas into the chamber through a one way gas intake valve by the creation of a partial vacuum within the chamber. The piston is then released and biased forward to compress the gas within the chamber. The compressed gas is stored within the chamber until it is released at high velocity through a conduit by a user's opening a second expulsion valve by means of a trigger where it then passes in the vicinity of an exit end of a conduit leading to the source of liquid to be sprayed and causes the suction of a quantity of that liquid into the path of the exiting gas in accordance with Bernoulli's Principle of inverse proportionality of fluid velocity and pressure. An atomized mixture of gas and liquid is thereby created and propelled generally in the direction of motion of the exiting gas. Applications for the device include the spraying of small localized quantities of insecticides, air freshening liquids, insect repellents, animal repellents, deicing solutions for locks in cold weather, water or any other liquid.

17 Claims, 7 Drawing Sheets

LIQUID ATOMIZING SPRAY GUN

FIELD OF THE INVENTION

This invention relates generally to spray guns for atomizing and propelling liquids, and more particularly discloses a single-burst spray gun which utilizes a high velocity discharge of gas to lift a quantity of liquid to be sprayed from a reservoir, atomize it, and spray it in any direction desired by the user.

BACKGROUND OF THE INVENTION

Devices for spraying liquids or liquid-gas mixtures for various purposes such as applying paint, insecticide, herbicide, water, fertilizer solutions and cleaning solutions exist in the prior art; indeed, several of these devices have been the subject matter of United States Patents and various configurations of such devices have been disclosed. In general terms, the fundamental objective of each such apparatus has been similar: To direct a pressurized gas through a conduit which conduit is in communication with a source of liquid to be sprayed, to draw upon the liquid, convert it to a spray or mist (i.e., atomize it) and discharge it from the liquid source onto a surface or into the air some distance from the liquid source. The differences among these spraying devices have primarily resided in the mechanisms employed to achieve the objective. Some of these prior mechanical arrangements have resulted in devices which spray in successive, finite bursts while others rely on a continuous flow of gas to discharge atomized liquid in an essentially continuous flow. Five patented devices relevant to the instant invention are briefly discussed below.

U.S. Pat. No. 1,822,553 issued to L. P. Uphoff et al. in 1928 discloses a spraying device which has a container for paint to be sprayed with a tube extending from the top of the container where it terminates in a nozzle. Movable into and out of perpendicular alignment with the paint tube is an air (gas) tube terminating in a nozzle which air tube is connected to a supply of air under pressure for expulsion through the nozzle. The device is directed toward paint spraying and is therefore dependent upon a continuous flow of gas through the air tube to deliver an even amount of paint to the surface being painted.

U.S. Pat. No. 2,127,189 to Scullari discloses one example of a single-burst spraying device wherein the squeezing action of a user's hand is directly responsible for the compression and ejection of a burst of gas under pressure through a port and over a liquid conduit which is in communication with the container storing the liquid to be sprayed. Specifically, the user's squeezing of a trigger moves a piston inside a gas cylinder to compress gas in the cylinder between the piston and a partition to force the gas through a hole in the partition and over the open end of the liquid conduit. When the user releases the trigger, the trigger is drawn back to an at-rest position by a spring and is ready to be squeezed again for the discharge of another finite burst of gas.

U.S. Pat. No. 2,264,312 discloses a spraying device which depends on a continuous flow of gas to produce a continuous spray of finely divided liquid particles.

U.S. Pat. No. 2,635,921 recites in every claim for the device described therein a "cartridge of self-pressurizing fluid propellant." Specifically, the invention relies on a prepackaged, disposable container of pressurized gas which is then mounted to the device and punctured by a piercing tool on the body of the sprayer itself allowing the gas in the cartridge to come into communication with a regulator assembly for controlled discharges of gas therefrom. This device is capable of producing both short, finite bursts or longer, more continuous discharges of gas and liquid depending on the length of time the user depresses the trigger.

Like the invention of U.S. Pat. No. 2,127,189 to Scullari, the invention disclosed in U.S. Pat. No. 4,477,023 to Gates relies upon the user's squeezing of a trigger to pressurize and discharge gas through a port in finite bursts whereinafter a spring returns the trigger to its at-rest position and awaits subsequent activation by the user.

Of the devices described, the ones relating to continuous gas flow are less relevant to the present invention than those that discharge individual, finite bursts of gas and spray; the instant invention is generally of the latter type in that it produces single, finite bursts of gas and gas/liquid mixture. However, the mechanisms employed in the present invention for producing gas/liquid spray are substantially different from those employed in the two patented devices described above that produce finite bursts, namely, those of U.S. Pat. No. 2,127,189 to Scullari et al. and U.S. Pat. No. 4,477,023 to Gates, and yield corresponding advantages over these two devices. As previously described, the user of the Scullari and Gates devices must squeeze a trigger to translate a piston within a cylinder to pump gas through an exit port under pressure; in both instances gas is ejected for the duration of the user's squeezing action. If the user squeezes slowly, the gas discharge will be of a longer duration at a lower pressure within the gas chamber than if the user squeezes the trigger rapidly. There are two problems inherent in both prior designs. First, the user cannot reliably duplicate the rate at which he or she squeezes the trigger in order to regularly produce bursts of substantially equivalent duration, pressure and quantity. Second, in those applications where aim is important for spraying a particular region on a surface, the aim of the user is interfered with throughout the pulling of the trigger. This deviation in aim increases as a function of the force imparted to the trigger by the user. This principle is analogous to the proposition that it is generally easier to hit a target with the bullet from a handgun when the trigger is a "hair-trigger" as opposed to a trigger requiring substantial force over a substantial distance to discharge the gun.

The instant invention alleviates both difficulties discussed above and provides further advantages and objectives which are stated explicitly below or will be implicit to a user.

SUMMARY OF THE INVENTION

It is an object of the present invention to provide a compact, easy-to-use liquid atomizing spray gun for a variety of applications.

It is a further object of this invention to provide a liquid atomizing spay gun that sprays in individual bursts of a finite amount of gas/liquid mixture and which does not depend for pressurizing the atomizing and propelling gas on the squeezing of a trigger while aiming the device.

It is a further object of this invention to provide a spray gun which utilizes a cooperating gas chamber and piston to alternately draw gas into the chamber and expel gas from the chamber wherein the piston is not driven by or otherwise directly mechanically linked to the trigger.

The above and other objects are achieved in accordance with the present invention which, according to a first embodiment provides a sprayer housing which is generally in the shape of a pistol for convenient grasping and operation. The housing includes a chamber and a gas tight piston, reciprocable backward and forward within said chamber, which cooperate to draw gas (which in most case will be air drawn from the atmosphere surrounding the sprayer) into the chamber through a one-way valve in the wall of the chamber by the piston's movement creating a partial vacuum inside the chamber. The piston is biased forward in a position of compression by a spring or other biasing means so that when the force drawing the piston backwards is released, and the chamber is filled with gas, the one way valve will be closed and the piston will translate forward compressing the gas within the chamber.

In selective fluid communication with the portion of the chamber which contains compressed gas is a gas conduit leading from the chamber to a point forward the chamber. The gas conduit passes in the vicinity of the exit end of a liquid conduit, which liquid conduit leads to a reservoir of whatever liquid is to be sprayed. The gas conduit is made to be in selective fluid communication with the chamber by a gas expulsion valve which alternately opens and closes the fluid passage from the chamber to the end of the gas conduit. This expulsion valve, which is operable by the user from outside the housing, is biased in a normally closed position by a coil spring or any other suitable biasing means and may be moved into an open position by the user through a trigger or other suitable or equivalent mechanical linkage.

When the chamber contains compressed gas and the user opens the expulsion valve, gas passes from the chamber and through the gas conduit at a high velocity. As the gas passes the vicinity of the liquid exit end of the liquid conduit, it will create a low pressure system in that vicinity in accordance with Bernoulli's principle of fluid dynamics. A higher pressure (most commonly atmospheric) above the liquid in the liquid reservoir will force liquid through the liquid conduit and into the path of the high velocity gas which will in turn atomize and propel the liquid in the general direction of the high velocity gas.

Included among the applications for the invention are the spraying of insecticides, air freshening liquids, insect repellents, animal repellents, deicing solutions for locks in cold weather, water or any other liquid. Due to the nature in which the device sprays, it does not lend itself particularly well to applying paint were continuous flows of paint are needed to ensure smooth and uniform application; however, the device could be used to spray individual bursts of paint wherever the same are needed. For example, small sprays of paint may be needed to mark trees or other objects on construction or excavation sites, etc.

Other objects, features, and advantages of this invention will occur to those skilled in the art from the following description of a preferred embodiment of the present invention and the accompanying drawings.

DETAILED DESCRIPTION OF THE PREFERRED EMBODIMENT

Figure 1:
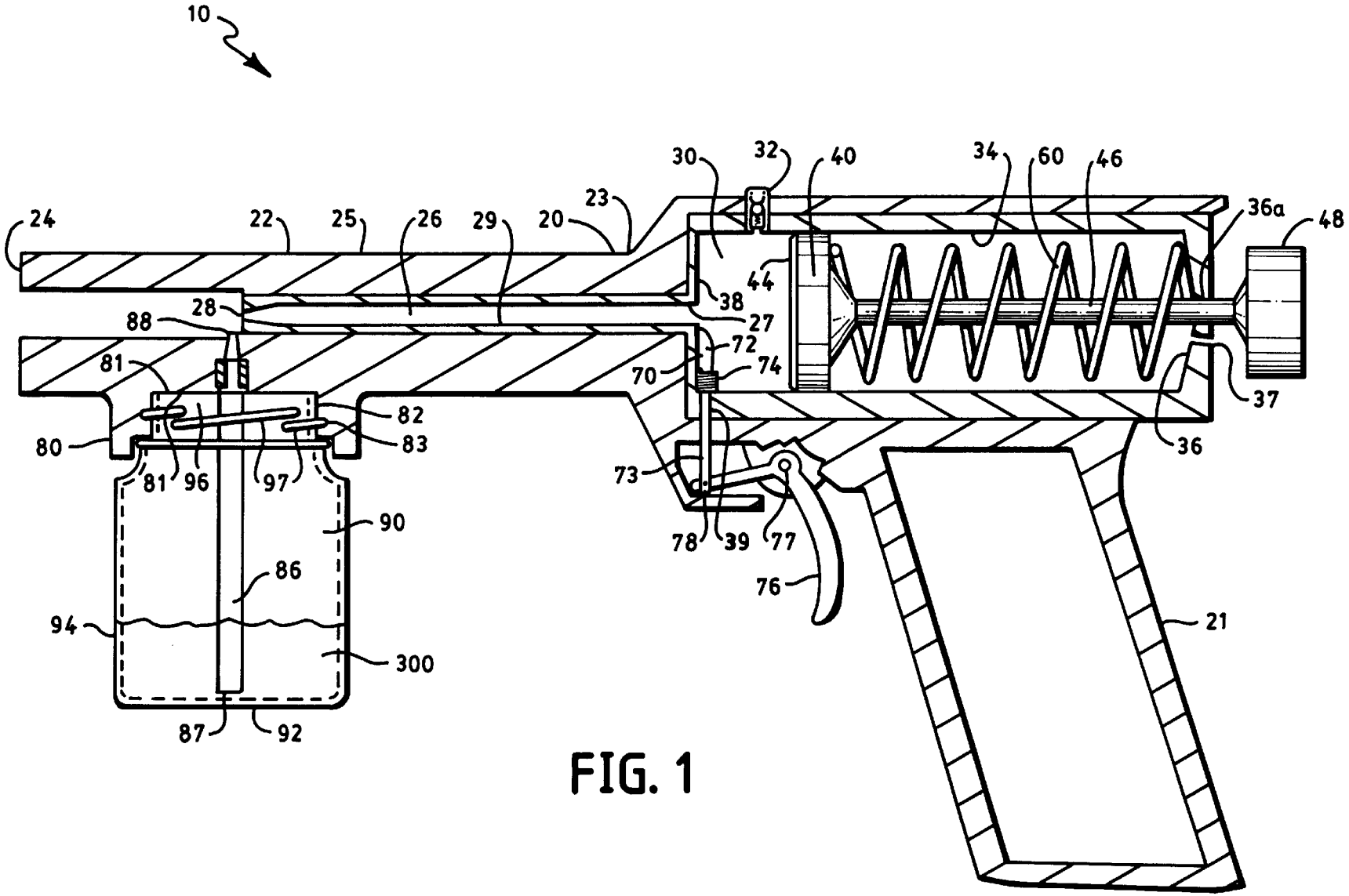
FIG. 1 depicts a left side sectional view of the preferred embodiment.

There is shown in FIGS. 1 through 5 a liquid atomizing spray gun 10 according to a preferred embodiment of the present invention. Spray gun 10 comprises a sprayer housing 20 which includes among its principal components, a handle 21, a forwardly extending elongated barrel 22 which has a back end 23, a front end 24 and a side wall 25; an elongated gas conduit 26 within barrel 22; a gas chamber 30 which is in selective fluid communication with gas conduit 26, and a gas-tight piston 40 which is reciprocable within chamber 30 between an extreme reward position and an extreme forward position and whose functions are to draw gas 200 into chamber 30 through one-way gas intake valve 32 and to compress gas 200 received into chamber 30 for high velocity expulsion through gas conduit 26. One way gas intake valve 32 is located in a side wall 34 of chamber 30, which is preferably cylindrical, at or adjacent the forward most position attainable by piston 40 within chamber 30 and is in fluid communication with the atmosphere so that when piston 40 is translated within chamber 30 toward its extreme rearward position, gas 200 is drawn into chamber 30 through valve 32. While any type of one way valve will suffice as long as the valve chosen can perform the function described in the manner desired, the embodiment presented in the drawings employs a ball and spring valve in which a valve ball 32*a* is biased by an intake valve spring 32*b* into a fitted intake valve seat 32*c* which is designed to receive ball 32*a* to make a gas-tight seal and close off gas intake port 32*d*. Such valve arrangements are well-known in the prior art and further explanation is therefore rendered unnecessary.

Figure 7:
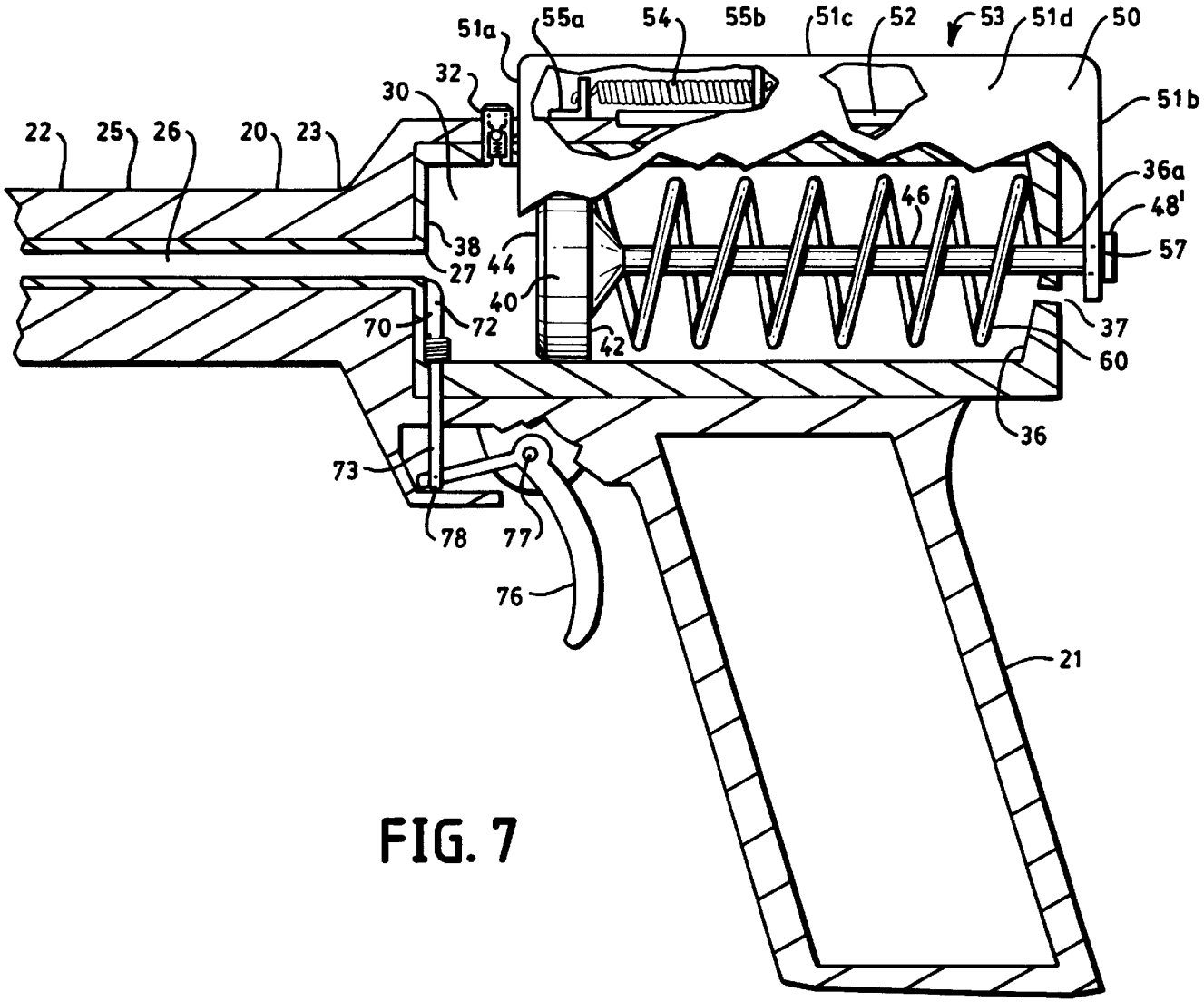
FIG. 7 is a left side sectional view of an alternative embodiment which employs a cocking slide to draw the piston rearward within the chamber.
Figure 9:
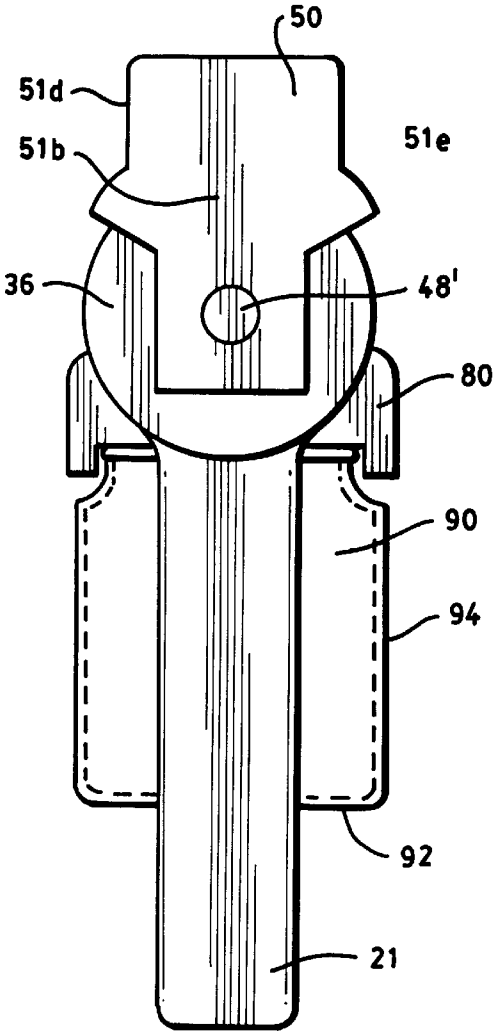
FIG. 9 is a rear end view of the embodiment of FIG. 7.
Figure 8:
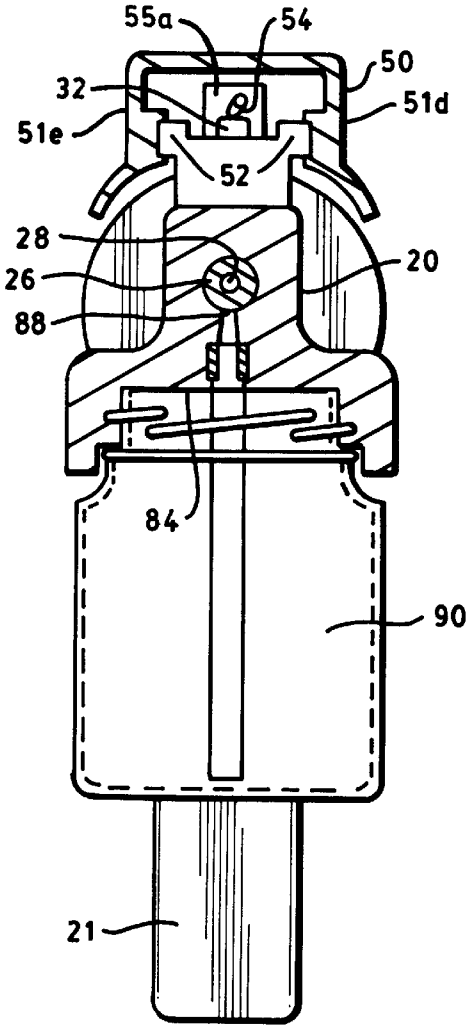
FIG. 8 is a front end view of the embodiment of FIG. 7.

Piston 40 is biased toward its forward most position within chamber 30 by compression coil spring 60 which is horizontally disposed within chamber 30 between the rear surface 42 of piston 40 and the rear wall 36 of chamber 30. Attached to and rearwardly extending from rear surface 42 of piston 40 is piston connecting rod 46 which terminates at its rear end in a cocking knob 48 as shown in FIG. 1 or is engagable at its rear end with cocking slide 50 as shown in FIGS. 7, 8, and 9. The configuration utilizing cocking knob 48 contributes to simplicity of manufacture, but may provide some inconvenience to the user. Where cocking knob 48 is used, it should be made of lightweight material such as plastic, wood, or a strong metal of low density. The reason for this will become apparent as the mode of operation of sprayer 10 is further discussed. The construction and mode of operation of the embodiment employing cocking knob 48 will readily occur to one of ordinary skill in the art while the mode of operation, construction and advantages to be realized by the embodiment employing cocking slide 50 warrants further explanation which is reserved until later in this description in a special section dedicated to this second design. All that need be understood at this point is that a means must be provided to enable the user to pull piston 40 rearward, against the forward biasing action of spring 60, to draw gas 200 into chamber 30 as described above and that, in one instance, that means is provided by connecting rod 46 and cocking knob 48 and, in a second instance, by cocking slide 50 which is mechanically linked to piston 40. In at least the configuration utilizing cocking knob 48, connecting rod 46 is slidably guided for forward and reward translation by and within connecting rod sleeve 36*a*, which is essentially a bore through the center of rear wall 36 of chamber 30. It is not necessary that sleeve 36*a* be gas tight because, for reasons obvious to those of ordinary skill, it is desirable that the gas pressure between rear surface 42 of piston 40 and rear wall 36 be at atmospheric pressure. Indeed, to ensure that this desired pressure is maintained, a small rear wall bore 37 may be provided in rear wall 36.

Figure 4:
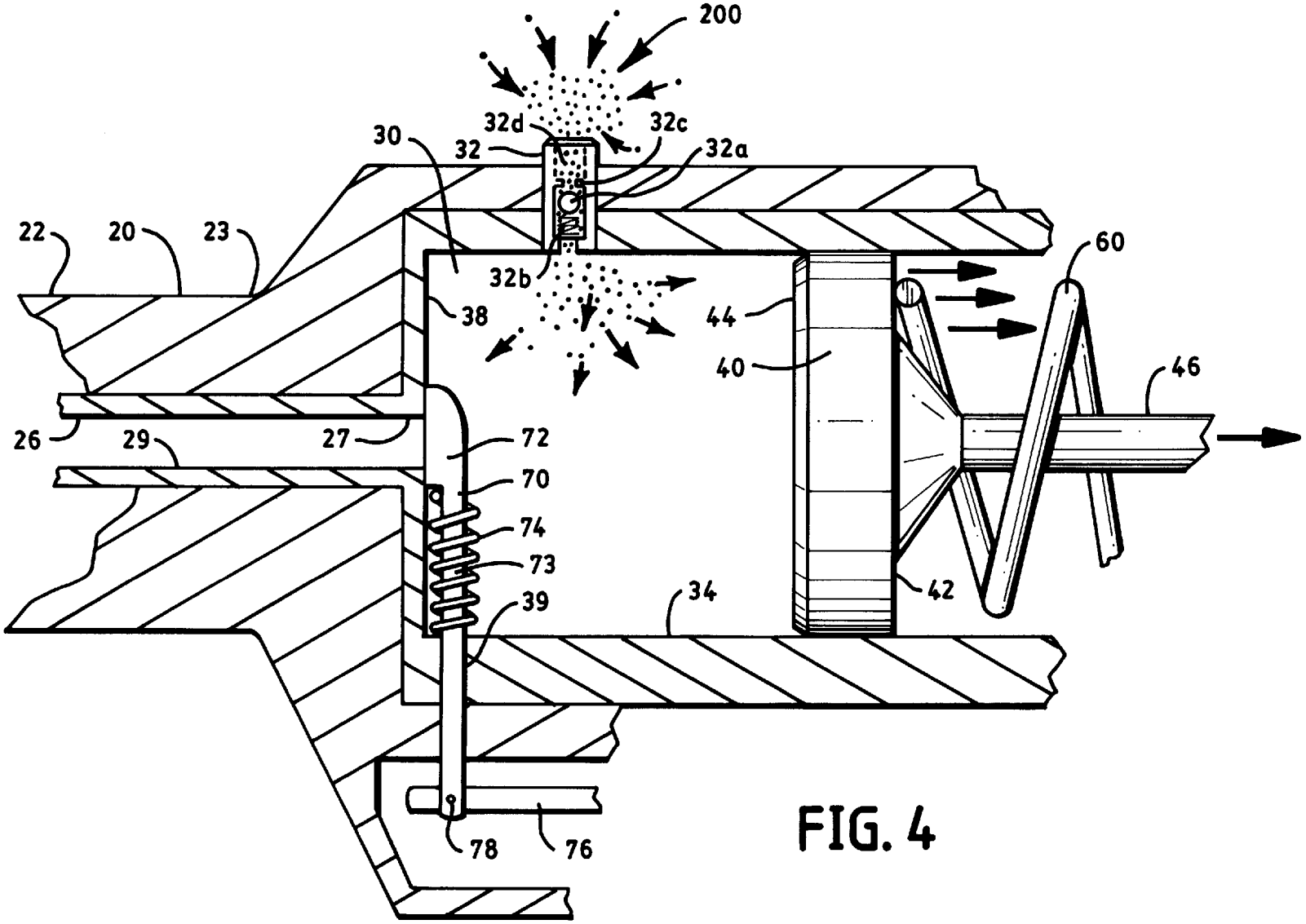
FIG. 4 shows an enlarged sectional left side view of the gas chamber, the gas intake valve, the gas expulsion valve, the gas conduit and the piston as gas is being drawn into the intake valve by the rearward translation of the piston.
Figure 5:
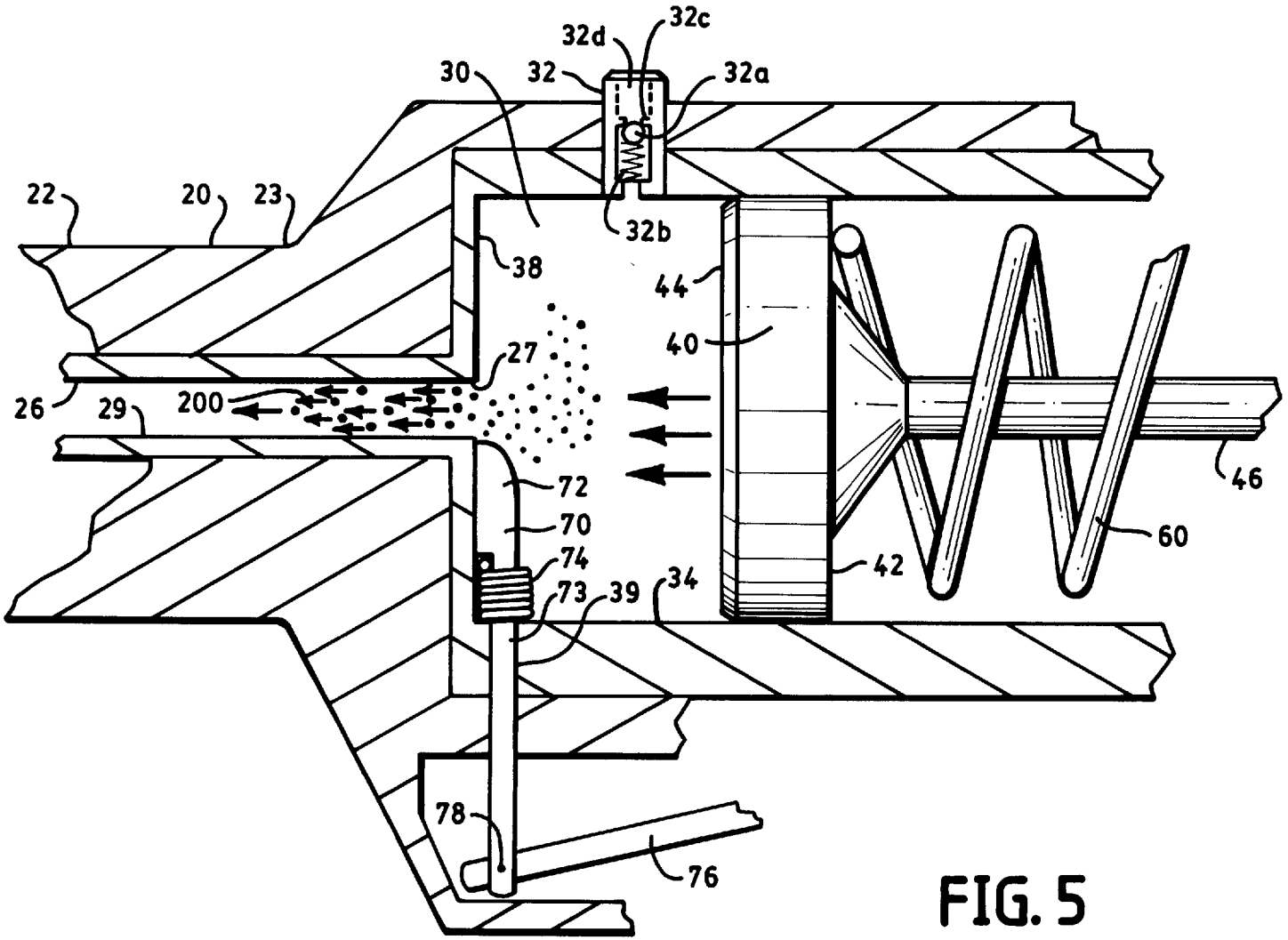
FIG. 5 shows an enlarged sectional left side view of the gas chamber, the gas intake valve, the gas expulsion valve, the gas conduit and the piston as gas is being expelled through the gas conduit.

When gas 200 is drawn into chamber 30 by the rearward translation of piston 40, coil spring 60 is compressed and stores potential energy U where $U=\frac{1}{2}kx^2$ where k is the spring constant of spring 60 and x is the linear displacement of compression of spring 60 in meters. FIG. 4 illustrates piston 40 being pulled rearward to draw gas 200 into chamber 30 as described. When piston 40 has been translated to its extreme rearward position by the user, chamber 30 is filled with its full compliment of gas 200, the pressure inside chamber 30 is equal to the pressure outside chamber 30, and valve 32 closes. Assuming for purposes of this aspect of the discussion that all other passages leading from the interior of chamber 30 to the atmosphere are also closed, when piston 40 is released by the user, it will be biased toward its forward most position within chamber 30 by the restorative spring force F of spring 60 where $F=-kx$ and k and x represent the same values discussed in connection with the energy of the spring above. The forward motion of piston 40 will compress gas 200 to some pressure P above atmospheric pressure and will continue to translate forward within chamber 30 until it reaches a position of equilibrium; that is, when the force of spring 60 acting in the forward direction on rear surface 42 of piston 40 is equal to and opposite the force produced by the pressurized gas 200 acting rearwardly on the front surface 44 of piston 40. The equilibrium position will place piston 40 somewhere between its forward most and rearward most positions within chamber 30. Those skilled in the art will readily appreciate that the equilibrium position of piston 40 may vary greatly depending on such variables as the radius of chamber 30, the length of chamber 30, spring constant k of spring 60, any changes in temperature in gas 200 after it is drawn into chamber 30, and the pressure gas 200 is under in the atmosphere adjacent intake valve 32 at the time gas 200 is drawn into chamber 30 and, further, that these variables may be manipulated to achieve many desired results.

In order for the invention to operate in the manner intended, it is necessary to include a means accessible from the outside of housing 20 for selectively releasing pressurized gas 200 from chamber 30 in a controlled manner. As previously stated, chamber 30 is in selective fluid communication with gas conduit 26 which conduit 26 is preferably cylindrical. Gas conduit 26 has an open gas intake end 27, an open gas expulsion end 28 and a side wall 29. Gas conduit 26 terminates at its gas intake end 27 in the front wall 38 of chamber 30 so that gas conduit 26 is in fluid communication with chamber 30. To permit a user to selectively open and close the fluid path (or gas passageway) leading from the interior of chamber 30 through conduit 26 to the atmosphere, a gas expulsion valve 70 is provided. As illustrated in detail in the sectional views of FIGS. 4 and 5, gas expulsion valve 70 includes a gas tight valve gate 72 which selectively opens and seals off the gas passageway through conduit 26, a valve stem 73 which is attached to valve gate 72 to control the latter's movement between its open and closed positions, a gas valve spring 74, which is preferably a coil spring that is disposed around valve stem 73, for biasing valve gate 72 into a normally closed position, and a trigger 76 that is pivotally attached to housing 20 at a trigger pivot pin 77 and to the lower portion of valve stem 73 at a valve stem pivot pin 78. Valve stem 73 is reciprocable within valve stem sleeve 39 in side wall 34 of chamber 30 and must be in gas tight engagement therewith so that gas 200 cannot pass into or out of chamber 30 through sleeve 39. When a user pulls trigger 76 backwards, valve gate 72 is pulled into an open position against the biasing action of valve spring 74 thereby allowing pressurized gas contained within chamber 30 to escape at a high velocity through gas conduit 26 and out expulsion end 28. When the trigger is released by the user, it is returned to its original, at-rest position and valve gate 72 is closed by the biasing action of spring 74. It should be noted that there are numerous possible configurations for expulsion valve 70, many of which will readily occur to one of ordinary skill in the art; it is therefore not the intention of the inventor to limit the scope of this invention by describing one such means for selectively opening and closing the gas passageway described and the location on spray gun 10 of said means.

Figure 3:
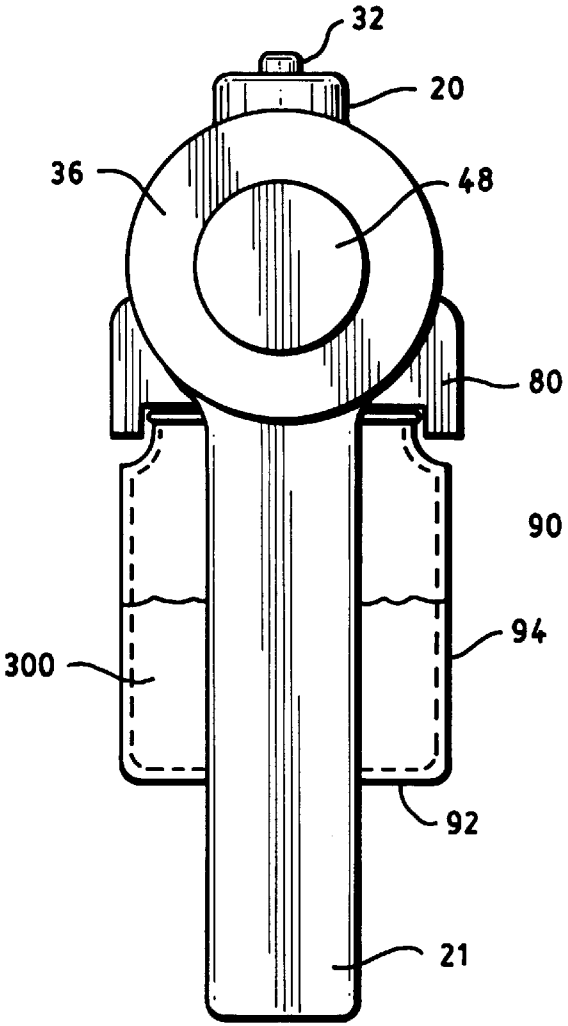
FIG. 3 shows a rear end view of the preferred embodiment.
Figure 2:
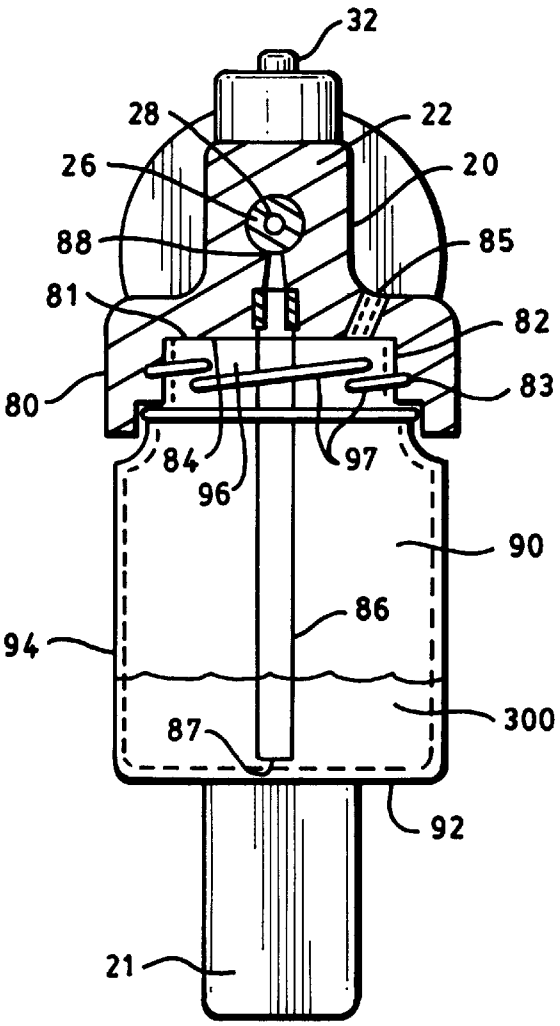
FIG. 2 shows a front end view of the preferred embodiment.

Disposed between back end 23 and front end 24 of barrel 22, and depending therefrom, is reservoir seat 80 as illustrated in FIGS. 1, 2, and 3. Reservoir seat 80 is a cap-like structure having a top wall 81 and a cylindrical side wall 82. The interior surface of cylindrical side wall 82 is provided with reservoir seat threads 83. Depending downwardly from top wall 81 is liquid conduit 86 which has a liquid intake end 87 and a liquid exit end 88. Liquid conduit 86 extends through top wall 81 so that there is fluid communication between points below and above top wall 81.

Reservoir seat 80 is designed to removably receive and sealably engage liquid reservoir 90. Liquid reservoir 90 is preferably generally cylindrical in shape and has a closed bottom 92, a side wall 94, and an open top 96. Disposed on the external surface of side wall 94, adjacent open top 96, are liquid reservoir threads 97. Liquid tight engagement between reservoir seat 80 and reservoir 90 is achieved by the threading engagement of reservoir seat threads 83 and reservoir threads 97. To ensure that the engagement between reservoir 90 and reservoir seat 80 is liquid tight, reservoir seal 84 may be provided which is preferably a ring made from a flexible material such as rubber.

When reservoir 90 is in place within reservoir seat 80, liquid conduit 86 extends downwardly into reservoir 90 to a point very near closed bottom 92 so that when reservoir 90 is filled with liquid 300, liquid intake end 87 is below the surface of liquid 300 even when only small quantities of liquid 300 are in reservoir 90.

Although liquid conduit 86 and gas conduit 26 are shown in the drawings as being roughly perpendicular and unattached, this does not have to be the case. Other configurations that will operate equally well include ones in which liquid conduit 86 is at an acute angle with respect to gas conduit 26 and still others in which liquid conduit 86 is joined with gas conduit 26 at some point along the length of gas conduit 26 between its gas intake and gas expulsion ends 27 and 28 at any angle desired. It will readily be appreciated by one of ordinary skill in the art that when liquid conduit 86 is configured to form an acute angle with gas conduit 26, liquid conduit 86 and gas conduit 26 should both be aligned such that liquid 300 and gas 200 will exit conduits 86 and 26, respectively, in the forward direction. In other words, if gas conduit 26 is horizontal, liquid conduit 86 should extend downward and backward from the vicinity in which liquid conduit 86 and gas conduit 26 meet.

Figures 6, 6A:
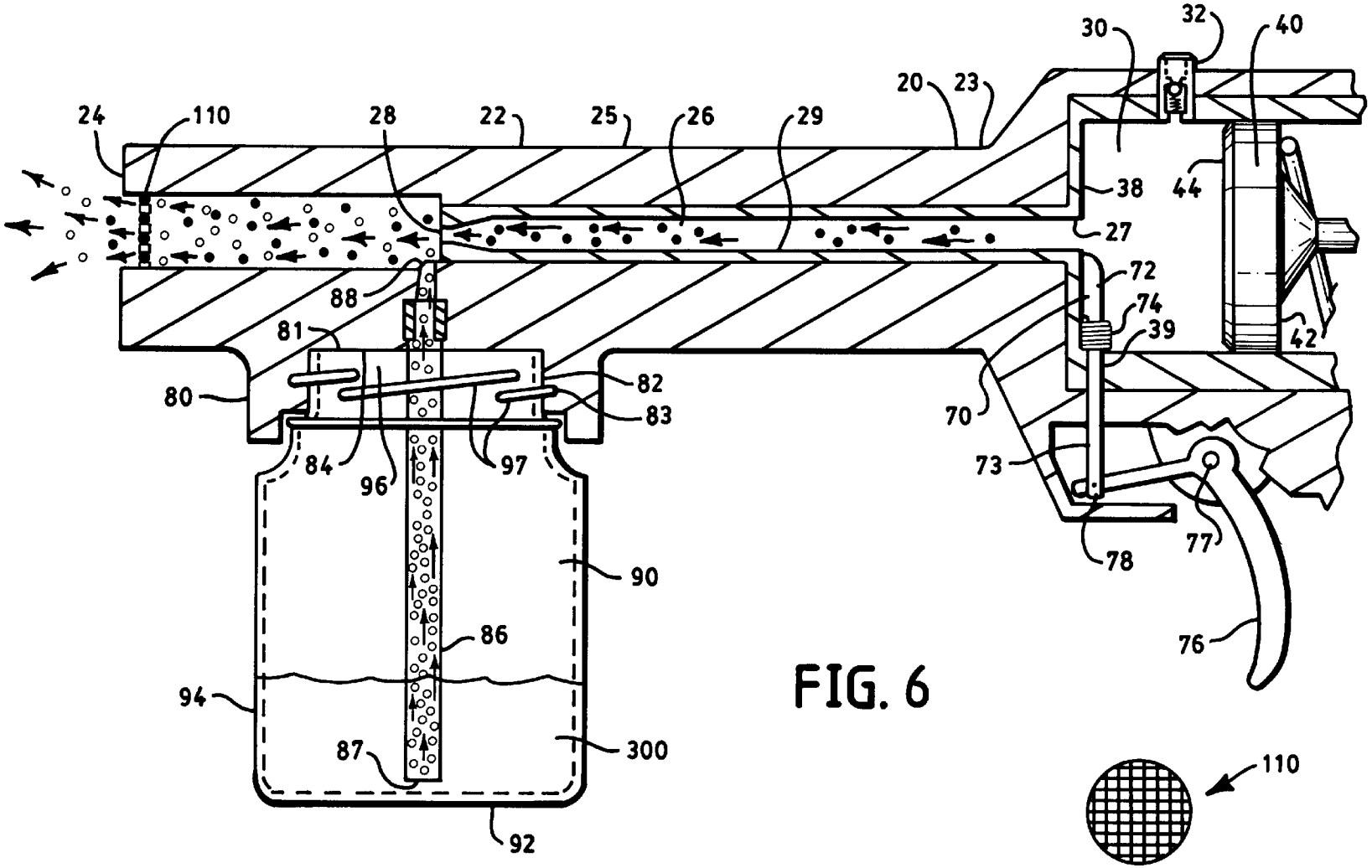
FIG. 6 depicts a left side sectional view of the preferred embodiments as the piston translates forward within the chamber and gas is forced through the gas conduit and over the exit end of the liquid conduit.
FIG. 6A illustrates a dispersion plate which may be included in the barrel of the device.

To complete the description of one complete cycle of operation of sprayer 10, it will be appreciated by those of ordinary skill that when gas expulsion end 28 and liquid exit end 88 are properly aligned, gas 200 being ejected under pressure at high velocity from chamber 30 through conduit 26 will create a localized low pressure system in the vicinity of liquid exit end 88 in accordance with Bernoulli's principle of fluid dynamics which dictates that the higher the velocity of a gas, the lower the pressure in the vicinity of its motion. This phenomenon is so well known that it need not be further described. The low pressure system created by the high velocity gas 200 passing by liquid exit end 88 will create a pressure differential between the gas pressure acting on the surface of the liquid 300 within reservoir 90 and the gas pressure at liquid exit end 88. The higher pressure within reservoir 90 will force liquid 300 up through liquid conduit 86, out liquid exit end 88, and into the path of the high velocity gas 200 at which point it will be atomized by gas 200 and propelled generally in the direction in which gas 200 is moving as it passes through conduit 26 as shown in detail in the sectional view of FIG. 6 in which particles of gas 200 are represented by solid dots and liquid 300 is represented by open circles and the direction of motion of both is illustrated by arrows. In those configurations of sprayer 10 where gas 200 atomizes and propels liquid 300 within barrel 22, a dispersion plate 110 may be disposed at or near front end 24 of barrel 22 to further atomize and disperse the atomized mixture of gas 200 and liquid 300 as it exits front end 24. Dispersion plate 110 may be a screen-like structure or other perforated structure as is commonly known in the art. Illustrated in FIG. 6A is a front view of such a dispersion plate 110.

As previously discussed, for sprayer 10 to operate as intended, it is important that the pressure differential between the gas acting on the surface of liquid 300 within reservoir 90 and the pressure in the vicinity of liquid exit end 88 as gas 200 is expelled from conduit 26 be great enough that liquid 300 is forced up liquid conduit 86 into the path of high velocity gas 200. It is the intention of the inventor that normal atmospheric pressures be sufficient for the gas over liquid 300 within reservoir 90. To ensure that this pressure remains at atmospheric pressure, a small bore 85 may be provided in top wall 81 of reservoir seat 80 as shown in FIG. 2 so that the atmosphere and the volume of gas above liquid 300 in reservoir 90 are in fluid communication. If the velocity of gas 200 is high enough as it passes over liquid exit end 88, then sprayer 10 will operate as intended. Numerous designs to alter and increase the above referenced pressure differential will occur to those of ordinary skill in the art, including ones which employ pumps to raise the gas pressure within reservoir 90 above atmosphere, and are within the scope and contemplation of this invention. It will also be readily understood by those of ordinary skill in the art that the velocity of gas 200 through conduit 26 may be varied through the manipulation of certain variables such as the ratio of the diameters of chamber 30 and conduit 26 and the spring constant k of spring 60. Furthermore, the source of gas 200 need not be limited to the atmosphere as numerous other sources, even high pressure sources, are envisioned and may at times be desirable.

DETAILED DESCRIPTION OF TWO EMBODIMENTS EMPLOYING A COCKING SLIDE TO PULL THE PISTON REARWARD

As previously discussed, embodiments employing a cocking slide 50 as a means for drawing piston 40 rearward to fill chamber 30 with gas 200 have been contemplated by the inventor. In all other respects, a sprayer 10 constructed in accordance with a cocking slide assembly is the same in design as the configuration of the preferred embodiment. Two such cocking slide embodiments are disclosed below and described by reference to the same drawings, FIGS. 7, 8, and 9.

A configuration employing cocking slide 50 is mechanically more complex than the cocking knob embodiment and requires more hardware which adds to the overall weight of sprayer 10. However, depending on how it is constructed, one or both of two advantages worthy of particular note may be realized. First, as can be seen in the FIGS. 7, 8, and 9, cocking slide 50 is accessible from the top of housing 20 which makes it more accessible for activation to the hand of the user opposite the hand holding sprayer 10. Secondly, in a second, more complex mechanical arrangement, cocking slide 50 may be pulled back against the forward biasing action of a slide spring 54 to bring piston 40 to its extreme rearward position, then released so that it returns to its normal, most forward rest position. The descriptions of both cocking slide configurations can be presented with reference to the same drawings.

In FIGS. 7, 8, and 9, there are illustrated the principal components necessary for the second, more complex cocking slide configuration. Cocking slide 50 has a front end 51*a*, a back wall 51*b*, a top wall 51*c*, a left side wall 51*d*, and a right side wall 51*e*. Cocking slide 50 is reciprocable between a most forward position and a most rearward position and slides between these two extreme positions on slide tracks 52 which are connected to either side of housing 20 and engage the insides of side walls 51*d* and 51*e* of cocking slide 50 as illustrated in FIG. 8. Tracks 52 confine cocking slide 50 to forward and rearward transitional motion.

Biasing cocking slide 50 into its most forward position is slide spring 54. Slide spring 54 is anchored at a first, front end to housing 20 by slide spring anchor 55*a* and at a second, rear end to the inside of top wall 51*c* of cocking slide 50 by slide spring anchor 55*b*.

Provided in back wall 51*b* of cocking slide 50 is a connecting rod bore 57 through which connecting rod 46 passes. A smaller cocking knob 48' is provided in the configuration employing cocking slide 50 because it need not be as large for direct gripping by a user as the knob 48 of the preferred embodiment.

In a first cocking slide configuration, cocking slide 50 is fixedly attached to connecting rod 46; and spring 54 and anchors 55*a* and 55*b* are eliminated. When cocking slide 50 is forced rearward by a user's hand, piston 40 moves rearward and draws gas 200 into chamber 30 as described in connection with the preferred embodiment. When the user lets go of cocking slide 50, piston 40 translates forward, carrying cocking slide 50 with it, until it reaches the equilibrium position described in connection with the preferred embodiment. When trigger 76 is pulled to open valve gate 72 so that compressed gas 200 is released from chamber 30 through conduit 26, cocking slide 50 is carried forward with piston 40. In short, in this first cocking slide configuration, cocking slide 50 is at all times in the same relative position with respect to piston 40. The advantage of this first configuration is that it is of somewhat simpler construction than the second configuration to be described. Two identifiable drawbacks of this first configuration are, first, the rapid forward motion of cocking slide 50, when trigger 76 is pulled, may cause injury to any portion of a person's hand that is in its path and, second, a portion of spring 60's remaining potential energy $U=\frac{1}{2}kx^2$ as discussed above and the potential energy of the compressed gas 200, $U_g$, will be dissipated in translating the additional hardware of cocking slide 50 forward instead of being put to use forcing gas 200 out of chamber 30. It will readily occur to those of ordinary skill in the art that the quantity of total potential energy $U_T$ of the system (i.e., potential energy of spring 60 plus the potential energy of compressed gas 200) lost in moving hardware forward will be equal to $\frac{1}{2}mv^2$ where m is equal to the mass of the hardware and v is equal to the velocity attained by the hardware. It is therefore desirable that cocking slide 50 be made of as light and durable a material as possible to minimize wasted energy.

The second cocking slide configuration, the components of which have already been discussed, eliminates the two drawbacks identified in connection with the first configuration, but is mechanically more complex than the first and may therefore add to the overall weight of sprayer 10 and to the cost of manufacture. Most notably, the second configuration includes spring 54 and spring anchors 55*a* and 55*b*. For the second configuration to operate has intended, it is required that cocking slide 50 be selectively engagable with connecting rod 46 or be otherwise selectively engagable with piston 40. Specifically, cocking slide 50 must be capable of drawing piston 40 rearward as previously described and then, when cocking slide 50 is released, be disengaged from piston 40 so that cocking slide 50 can return all the way to its most forward rest position. This is achieved in a relatively straight forward manner; making connecting rod 46 slidable within bore 57 in back wall 51*b* of cocking slide 50. The second cocking slide configuration operates in the manner described below.

As with the first cocking slide configuration, cocking slide 50 is drawn rearward by the user to cause piston 40 to draw gas 200 into chamber 30 through valve 32. As cocking slide 50 is translated rearward, back wall 51*b* engages cocking knob 48'. When cocking slide 50 has been drawn all the way rearward so that piston 40 has reached its extreme rearward position, cocking slide 50 is released by the user and cocking slide 50 and piston 40 both move forward until piston 40 reaches its equilibrium position; however, cocking slide 50 continues translating forward, disengaging from contact with cocking knob 48', under the biasing force of spring 54 until cocking slide 50 comes to rest in its extreme forward position on tracks 52. When trigger 76 is pulled to release gas 200 from chamber 30, piston 40 translates forward and comes to rest and a complete cycle of operation of sprayer 10 has been completed. It will readily occur to those of ordinary skill in the art that numerous mechanisms may be employed to provide a cocking slide biasing means of which spring 54 in only one. Furthermore, the embodiment having a cocking slide 50 that is selectively engagable with cocking knob 48' need not include a cocking slide biasing means at all and instead may rely on a user's manually returning cocking slide 50 to its most forward position.

The foregoing is considered to be illustrative only of the principles of the invention. Furthermore, since numerous modifications and changes will readily occur to those skilled in the art, it is not desired that the foregoing limit the invention to the exact construction and operation shown and described. Accordingly, all suitable modifications and equivalents may be resorted to that appropriately fall within the scope of the invention. Other embodiments therefore will occur to those skilled in the art and are within the scope of the following claims:

What is claimed is:

1. A liquid-atomizing spray gun comprising:

a sprayer housing having an internally disposed gas chamber with a rear wall, a front wall, and a side wall and containing a gas-tight piston reciprocable within said chamber between an extreme rearward position and an extreme forward position, said piston having a rear surface and a front surface;

a normally closed one way gas intake valve leading from a source of gas to the interior of said chamber and situated such that rearward translation of said piston within said chamber causes the opening of said intake valve and the introduction of gas into said chamber through said intake valve;

forward biasing means engaging and urging said piston toward its extreme forward position within said chamber for compressing gas introduced into said chamber between said front wall of said chamber and said front surface of said piston, said piston having an equilibrium position during compression of gas within said chamber which equilibrium position lies between said extreme rearward and extreme forward positions and is reached when the forces during gas compression acting rearwardly on said piston are equal and opposite the forces acting forwardly on said piston;

piston drawing means connected to said piston, and accessible from outside said housing, for enabling a user to draw said piston toward its extreme rearward position within said chamber against said forward biasing means to draw gas into said chamber through said intake valve;

an elongated gas conduit having an open gas intake end, an open gas expulsion end and a side wall extending between said gas intake and gas expulsion ends, said gas intake end being disposed in at least one of said front wall and said side wall of said gas chamber at a point between said front wall of said chamber and said front surface of said piston when said piston is in its extreme forward position so that said chamber is in fluid communication with said gas conduit and there is defined by said chamber and said gas conduit a gas passageway beginning in said chamber and extending through said gas expulsion end of said gas conduit;

valve means accessible from outside said housing for selectively closing and opening the gas passageway extending between said chamber and said gas expulsion end of said gas conduit, said valve means being movable between a closed position for preventing pressurized gas from escaping from said chamber through said gas conduit and an open position for allowing pressurized gas to escape from said chamber through said gas conduit at high velocity;

a reservoir for containing a liquid to be atomized and sprayed;

a liquid conduit having an open liquid intake end and an open liquid exit end; said liquid intake end being in fluid communication with a quantity of liquid contained by said reservoir, said liquid exit end being sufficiently aligned with said gas expulsion end of said gas conduit so that when pressurized gas is permitted to escape from said chamber at high velocity through said gas expulsion end, the exiting gas will create a low pressure system in the vicinity of said liquid exit end sufficient to cause a substantial enough pressure differential between a gas pressure acting on the surface of the liquid within said reservoir and the vicinity of the high velocity gas to cause the higher pressure within the reservoir to force a quantity of liquid through said liquid conduit and out said liquid exit end into the path of the high velocity gas by which it will be atomized and sprayed substantially in the direction of motion of the exiting gas.

2. The spray gun of claim 1 wherein the sprayer housing is substantially in the shape of a pistol and includes a handle for griping by a user and a barrel extending forwardly from a back end to a front end, said barrel containing said gas conduit therein.

3. The spray gun of claim 2 wherein said reservoir is removably attached to said barrel between said back and front ends of said barrel.

4. The spray gun of claim 2 wherein said piston drawing means includes a piston connecting rod which is attached to and rearwardly extends from said rear surface of said piston through a connecting rod sleeve in the center of said rear wall of said chamber where it terminates in a cocking knob, said connecting rod being slidably guided during reciprocation of said piston by said connecting rod sleeve.

5. The spray gun of claim 4 wherein said forward biasing means urging said piston toward its extreme forward position comprises a coil spring disposed around said connecting rod which coil spring is linearly compressible between said rear surface of said piston and said rear wall of said chamber.

6. The spray gun of claim 2 wherein said valve means for selectively closing and opening the gas passageway comprises a valve gate disposed within said chamber which is reciprocable between a normally closed position in which it is in gas tight engagement with said gas intake end of said gas conduit to prevent pressurized gas from escaping from said chamber and an open position in which pressurized gas within said chamber is permitted to enter said gas intake end of said conduit and escape through said expulsion end of said conduit, said valve gate being biased by a valve spring into its normally closed position, said valve gate further being connected to a valve stem which extends through a gas tight valve stem sleeve in at least one of said front and side wall of said chamber to a location outside said chamber where it is accessible to a user for the opening of said valve gate against the biasing action of said valve spring.

7. The spray gun of claim 6 further comprising a trigger which is pivotally mounted to said housing in front of said handle and engages said valve stem such that the pulling of said trigger from an at rest position toward said handle causes the movement of said valve gate into its open position and the releasing of said trigger after pulling toward said handle causes it to return to its at rest position by the biasing action of said valve spring.

8. The spray gun of claim 2 further comprising a dispersion plate proximate said front end of said barrel in the path of the atomized mixture of gas and liquid to further atomize and disperse the same.

9. The spray gun of claim 8 wherein said dispersion plate is removable.

10. The spray gun of claim 1 wherein the source of gas from which one way gas intake valve leads to the interior of said chamber is the atmosphere surrounding said spray gun.

11. The spray gun of claim 2 wherein the source of gas from which one way gas intake valve leads to the interior of said chamber is the atmosphere surrounding said spray gun.

12. The spray gun of claim 3 wherein said liquid reservoir has a closed bottom, a side wall, and an open top and said housing further comprises a liquid reservoir seat attached to said barrel with means for removably receiving and sealably engaging said open top of said reservoir.

13. The spray gun of claim 12 wherein said reservoir seat includes a bore therein leading from the space above any quantity of liquid within said reservoir to the atmosphere surrounding said spray gun so that the pressure above any quantity of liquid within said reservoir is maintained at substantially atmospheric pressure.

14. The spray gun of claim 2 wherein said piston drawing means comprises a piston connecting rod which is attached to and rearwardly extends from said rear surface of said piston through a connecting rod sleeve in the center of said rear wall of said chamber to the outside of said chamber, said connecting rod being slidably guided during reciprocation of said piston by said connecting rod sleeve, and a cocking slide accessible from, and slidably mounted to, the top of said housing, said cocking slide being fixedly attached to said connecting rod and reciprocable between a most forward position and a most rearward position corresponding to the extreme forward and extreme rearward positions of said piston respectively.

15. The spray gun of claim 4 wherein said piston drawing means further comprises a cocking slide accessible from, and slidably mounted to, the top of said housing and being reciprocable between a most forward position and a most rearward position corresponding to the extreme forward and extreme rearward positions of said piston respectively, said cocking slide having a back wall with a bore therein for slidably receiving said connecting rod therethrough so that said cocking slide is selectively engagable with said cocking knob of said connecting rod such that when said cocking slide is drawn toward its most rearward position, its back wall engages said cocking knob to draw said piston to its extreme rearward position, but when said piston has reached its extreme rearward position and is permitted to move forward to its equilibrium position during compression of gas within said chamber, said cocking slide can continue moving forward toward its most forward position by the disengagement of its rear wall with said cocking knob.

16. The spray gun of claim 15 further comprising cocking slide biasing means for biasing said cocking slide into its most forward position so that when said rear wall of said cocking slide becomes disengaged from said cocking knob during forward translation of said piston and said cocking slide, said cocking slide returns to its most forward position automatically.

17. The spray gun of claim 16 wherein said cocking slide biasing means comprises a slide spring which is attached at one end to said housing and at an opposite end to said cocking slide.

* * * * *